US006146498A

United States Patent [19]

Hsu et al.

[11] Patent Number: 6,146,498

[45] **Date of Patent: *Nov. 14, 2000**

[54] WOUND PRODUCT CORES AND PROCESSES FOR MAKING THEM

[75] Inventors: Jay C. Hsu, Alpharetta, Ga.; James J. Tanner, Winneconne, Wis.

[73] Assignee: Kimberly-Clark Worldwide, Inc., Neenah, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 08/846,697

[22] Filed: Apr. 30, 1997

[51] Int. Cl.[7] ..... D21F 13/00

[52] U.S. Cl. ..... 162/189; 162/218; 162/227; 162/DIG. 9

[58] Field of Search ..... 162/4, 100, 164.1, 162/189, 190, 208, 210, 218, 224, 226, 227, 231, DIG. 9; 264/37, 115, 119, 120, 122; 428/34.1, 34.2, 35.6, 35.7

[56] References Cited

U.S. PATENT DOCUMENTS

| | | | |
|---|---|---|---|
| 3,884,755 | 5/1975 | Frost, III . | |
| 3,895,997 | 7/1975 | Haywood . | |
| 3,895,998 | 7/1975 | Haywood et al. | 162/100 |
| 4,221,751 | 9/1980 | Haataja et al. | 264/119 |
| 4,303,019 | 12/1981 | Haataja et al. . | |
| 4,828,643 | 5/1989 | Newman et al. | 156/328 |
| 5,215,625 | 6/1993 | Burton . | |
| 5,318,235 | 6/1994 | Sato . | |
| 5,332,474 | 7/1994 | Maxham . | |
| 5,356,518 | 10/1994 | Kelley et al. | 162/224 |
| 5,478,441 | 12/1995 | Hamilton . | |
| 5,496,441 | 3/1996 | Tran . | |
| 5,527,432 | 6/1996 | Leuthold et al. . | |
| 5,545,450 | 8/1996 | Andersen et al. . | |
| 5,573,638 | 11/1996 | Lennon et al. . | |
| 5,582,682 | 12/1996 | Ferretti . | |
| 5,586,963 | 12/1996 | Lennon et al. . | |
| 5,614,307 | 3/1997 | Andersen et al. . | |
| 5,795,377 | 8/1998 | Tanner et al. | 106/164.4 |

FOREIGN PATENT DOCUMENTS

| | | |
|---|---|---|
| 1275042 | 5/1972 | United Kingdom . |

*Primary Examiner*—Peter Chin

*Attorney, Agent, or Firm*—Nelson Mullins Riley & Scarborough

[57] ABSTRACT

The present invention provides a core for receiving a wound product wherein the core is made of a waste sludge produced in a papermaking process. The process for making the core includes the steps of mixing the sludge with a binder material, which may be either a wet strength or a dry strength agent, and then compressing the mixture into a core through a process such as extrusion or molding. Optionally, the sludge may be dried prior to mixing with the binder material.

17 Claims, 3 Drawing Sheets

WOUND PRODUCT CORES AND PROCESSES FOR MAKING THEM

FIELD OF THE INVENTION

The present invention is directed to the field of making useful products, such as cores for tissue and other rolled or wound products, from papermaking fiber sludge.

BACKGROUND OF THE INVENTION

Paper is conventionally made by draining a low consistency dispersion of cellulose fiber pulp, fillers, and additives through a paper machine "wire" (essentially an endless mesh or sieve). A certain amount of solid material passes through the wire with the suspending water and is, thus, not retained in the wet paper web formed on the wire. The drained liquid suspension, known generally in the industry as "white water," carries entrained solid material. White water from which the suspended particles have been removed is re-used in the papermaking process to the extent possible.

Obviously, wastepaper, if it can be recycled, is a much cheaper and environmentally friendly source of wood pulp for making paper. Before wastepaper can be reused as recycle material, however, the wastepaper must be de-inked. De-inking processes remove inks and coating materials from the wood fibers. Thus, when recycled fibers, as opposed to virgin pulps, are used in the papermaking process, the drained liquid suspension will contain additional types of waste materials such as inks and hot melt adhesives.

Unused white water and de-inking effluents must be treated before being discharged from the paper mill. Treatment normally involves passing the effluent through a clarifier, prior to which flocculants are added to promote sedimentation of solid material suspended in the water. A biological treatment with microorganisms is also commonly performed to reduce the biological oxygen demand (BOD) of the liquid effluent before it is discharged. As can be expected, disposal of the unused white water and de-inked effluents results in costs to the papermaking facility.

The sediment accumulated in the clarifier is a sludge composed of pulp fibers, fiber particles or fines, fillers, pigments, and other miscellaneous debris such as grit, sand, plastic particles, general dirt. Many of the sludge components are fillers, pigments and the like that were added to the pulp during the sheet-forming process for the purpose of producing desired properties in the finished paper. Such properties include proper surface, opacity, strength and brightness. For example, finely ground inorganic fillers, such as talc, certain clays, calcium carbonate, blanc fixe, and titanium dioxide may be added to papers to improve surface smoothness, whiteness, printability and opacity. Sizing agents, such as soaps, gelatins, and rosins (with alum), wax emulsions and starches, may be added to papers for improving resistance to penetration by liquids. In addition, coloring agents, such as acid, basic, direct and sulfur dyes and natural and synthetic pigments may be added for coloring purposes. Any of such products may ultimately end up in the clarifier as part of the sludge. In addition, because the clarifier is usually a large open-air tank, other debris such as leaves, branches, insects, etc. can also become part of paper sludge. The major constituents of the sludge, however, are generally fiber/fines and the inorganic fillers calcium carbonate and clay.

Most de-inking processes involve the use of flotation and washing. In de-inking processes, wastepaper is first washed and then pulped with dilute sodium hydroxide or surfactants in a pulper tank to cause the fibers to swell and loosen the ink and coating material particles contained thereon. (These coating materials include the previously mentioned clays, talc, etc.) After pulping, the pulp stocks go through screening, cleaning, washing, floatation, and bleaching to further remove trash, stickies, inks, ash, and short fiber fines. During the washing and floatation stages, most ash, stickies, and short fiber fines are separated from the pulp stock. Thus, when the sludge comes from a mill using recycled waste paper, this sludge may also have accumulations of adhesives (otherwise known as "stickies"), foreign bodies (such as pieces of plastic material or metal, otherwise known as "contraries") in very small quantities, and other additives, such as those described above, that are used in the papermaking process.

Normally, the sludge is drawn off from the clarifier at about 2.5 percent consistency (or "percent dry solids content") and is then dewatered to a consistency of around 20 to 55 percent, for example, by means of rotary vacuum filters, screw presses, or belt presses. Dewatering reduces the weight of material going to the landfill and reduces the charges for landfill disposal because these are typically based on weight. Since the majority of the weight in the sludge comes from water, it behooves the sludge processor to remove as much water as possible. The dewatered sludge is in a semi-solid state and usually contains about 40 percent to about 80 percent by dry weight relatively fine wood fibers and from about 20 percent to about 60 percent inorganics (also referred to as "ash") and the additives mentioned above. The material typically is a crumbly, not very cohesive material that appears to be dry. At thirty percent consistency, most sludges are more like dry solids as opposed to a suspension or dispersion. Because of the non-cohesive character of sludge, the materials handling equipment for moving, storing and transporting are generally the same as for dry materials. Once in this state, the sludge is then capable of being collected and transported for disposal in landfills.

According to some sources, it is estimated that the amount of dry waste (waste sludge with substantially all of the residual water removed) produced due to paper processing exceeds 4.6 millions tons per year. This sludge is produced by both papermaking from virgin pulp and papermaking from recycled fibers. A typical de-inking plant employing recycled fibers processes about 100 dry tons of waste paper into about 65 to about 80 dry tons of recycled (reusable) fiber. The remaining 20 to 35 tons of waste paper is unusable, and becomes part of the sludge produced by the deinking plant. After recycled fiber sludge is dewatered with various suitable dewatering devices, including, for example, a belt press or screw press, 100 dry tons of waste paper still produce from about 70 to about 120 wet tons of sludge which must be disposed.

Moreover, the sludge produced during the making of tissue from an integrated mill with a recycled fiber plant produces 10 times the amount of sludge produced during the making of tissue from virgin pulp. The typical virgin pulp tissue making process produces 10 tons of sludge per day at the typical commercial plant while the typical tissue making with recycled fiber plant produces 100 tons of sludge per day.

Conventional methods for disposing of sludges include landfill, land spreading, composting and incineration. Landfill and land spreading sites are being depleted at an alarming rate, and the establishment of new sites is difficult due to environmental concerns. In addition, the cost associated with using landfills to dispose of sludge is constantly increasing. For example, paper manufacturers typically spend about $30/wet ton to send sludge to the landfill. Composting and incineration of sludge also raise environmental concerns. Some innovative sludge disposal techniques include processing the sludge into pellets for fuel or into lightweight aggregates for construction, pyrolysis, gasification, and incorporation into cements. However, these techniques generally require the use of complex methods and expensive equipment. In addition, attempts to recycle sludge to make paper have been unsuccessful because the process is inefficient due to drainage problems resulting from the presence of slow drying fines which tend to clog the wires and other equipment.

Due to the extremely large amounts of waste sludge generated from both the virgin pulp papermaking and the recycled fiber papermaking processes, new uses of sludge are needed in order to curtail the disposal problems presently being encountered. Some attempts have been made to create such uses.

The prior art sets forth basically five different approaches for utilizing sludge in useful products:

(1) Pelletizing the sludge using high pressure and binders where the sludge is dried before pelletizing. The pellets can be used as absorbents or chemical carriers, e.g., fertilizer. Alternatively, large diameter pellets or cylinders are used as fuel.

(2) Extracting the fibers or fillers from sludge in various ways to subsequently use the extracted material in a paper and/or ceramic product. These are both wet and dry processes.

(3) Mixing the sludge with other construction ingredients such as concrete or plastic to embody the sludge as reinforcing fibers or filler. Again these are both wet and dry processes.

(4) Direct molding of sludge into large shapes (i.e., large cross section) and drying. These products are construction blocks or boards and can be made using both wet and dry processes. Some of these can be fired to burn out the cellulosic and polymeric materials, leaving a ceramic product.

(5) Some sludges are formed into particulates or briquettes of various forms and sizes. These are subsequently carbonized to make an activated carbon product.

U.S. Pat. No. 4,303,019 to Haataja discloses the making of pallets by molding paper mill sludge blended with a fibrous reinforcing material. U.S. Pat. No. 5,215,625 to Burton discloses the making of products such as stepping stones, acoustic paneling, flower pots and planters, sculptures, shipping containers and packing materials, and the like, from waste products such as ink and waste slurry from pulp manufacturing. The incorporation of de-inking byproducts from wastepaper recycling operations and pulp mill clarifier sludge into drywall and other gypsum-based building products is disclosed in U.S. Pat. No. 5,496,441 to Tran.

Attempts have also been made to recover and re-use the raw materials from paper mill waste sludge. For example, U.S. Pat. No. 5,478,441 to Hamilton discloses a process for recovering such raw materials. U.S. Pat. No. 5,332,474 to Maxham discloses a process for producing a papermaking filler product from the fiber fines/clay fraction of a pulp, paper, paperboard, or deinking mill waste solids.

While considerable prior art exists with regard to methods for handling, utilizing or recycling of sludge as outlined above, in actual fact there has been little commercial implementation. The majority of the materials classified as sludge from both deinking operations as well as conventional pulp and paper mills ends up in landfills or is discarded or disposed of in some other way. The major reason is that few of the many procedures available to convert sludges can produce products that have significant value.

The need to develop methods and processes that would use these waste materials, however, is growing. It is likely that environmental and regulatory pressures to recycle paper and paper products will increase. This will mean there will be more deinking and recycling operations in the future. In addition, it is likely that the percentage of inorganic materials in recycled paper, such as calcium carbonate and clay, will increase for a number of reasons. For example, calcium carbonate improves the long term stability of printing papers because the alkalinity of the calcium carbonate reduces the rate of discoloration and embrittlement of the paper. Additionally, both calcium carbonate and clay are used to increase the opacity of paper. In printing items such as magazines or advertising supplements, addition of inorganic materials allows for reductions in the amount of fiber used for the paper. The purpose for the added inorganic material is to provide superior opacity. In addition to the improved opacity, incorporation of clay as a coating or filler and calcium carbonate as a filler also provide improvements to the surface of the paper such that the quality of the printing is improved. Furthermore, wood pulp, even though it is a renewable resource, is becoming more expensive. The cost of wood pulp currently exceeds the cost of calcium carbonate or clay, and it, therefore, makes economic sense to include considerable amounts of these fillers in paper.

All of these trends act together to provide increases in the amounts of waste materials in the form of sludge that will be generated in the future. Therefore, there is a need for a commercially feasible method of utilizing papermaking sludge.

Rolled, or wound, paper products such as toilet tissue and kitchen towels are generally marketed on paperboard cores in the shape of a tube. These cores are commonly made by winding two narrow webs of paperboard core stock into a tube on a special mandrel while gluing the webs. Typically, the paperboard web will pass through an adhesive and then will be wound in spring-like fashion around a mandrel by a winding machine. Processes for making cores are disclosed in U.S. Pat. Nos. 5,573,638 and 5,586,963, both to Lennon et al.

The winding of papers onto the cores usually occurs in a continuous manner with the cores being fed to a turret tissue winder after making. On the turret tissue winder, the cores are rotated into position to have tissue wound onto them until they are of the proper diameter. The finished rolls are then rotated to another position and ejected from the machine while a new core is inserted.

The cores are usually made in lengths equal to the width of the parent tissue reel exiting the paper machine producing the tissue or paper product to be wound on the core. After the tissue or paper is wound onto the long cores, the cores (with paper rolled thereon) are cut into smaller, consumer-width rolls by sharp metal discs or saws. As soon as the consumer-sized rolls are cut, they are grouped into singles, pairs, or other configurations and then wrapped or inserted into plastic bags for shipping.

Cores are typically made of unbleached Kraft paper. Generally, the pulp for such paper is obtained by recycling corrugated fibers from paper bags or corrugated boxes. If white cores are desired, then the pulp will be bleached. It would be beneficial if a waste product, such as sludge, could be used to replace all or some of the paper necessary for making such cores.

SUMMARY OF THE INVENTION

It is an object of the present invention to provide an alternative use for paper mill and recycled fiber sludge.

Another object of the present invention is to provide a winding core made from waste materials.

It is a further object of the present invention to provide a winding core made from fiber sludge.

These and other objects are achieved by providing a method for producing a wound product core from paper mill sludge produced during the pulping of virgin pulp or from recycled fiber sludge produced during the de-inking and recycling of waste paper. For purposes of the present specification, papermaking processes include the making of paper from virgin pulp and/or recycled fiber, the making of virgin pulp from wood or other cellulosic materials, and the making of recycled fiber from waste paper.

Specifically, the process involves providing the waste sludge, drying it, mixing it with binders such as adhesives, including resins, starches, or the like, and then compressing the mixture into cores. The compression can be carried out by extrusion or by molding. Extrusion can be by continuous extruders such as heated single-screw extruders. Zoned heating may be utilized. In addition, a volume reduction extruder may be employed if the sludge is not first dried.

Alternatively, a molding process may be used as the compression step to obtain the desired cores. During this type of compression, the mixture is provided, for example, to a mold with a dual cylinder arrangement wherein an inner cylinder made of heat or pressure expandable materials is housed within an outer rigid cylinder or wherein the inner cylinder is rigid and the outer cylinder is radially contractible. After holding the temperature for a certain time, compression is released and the desired molded core is obtained.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
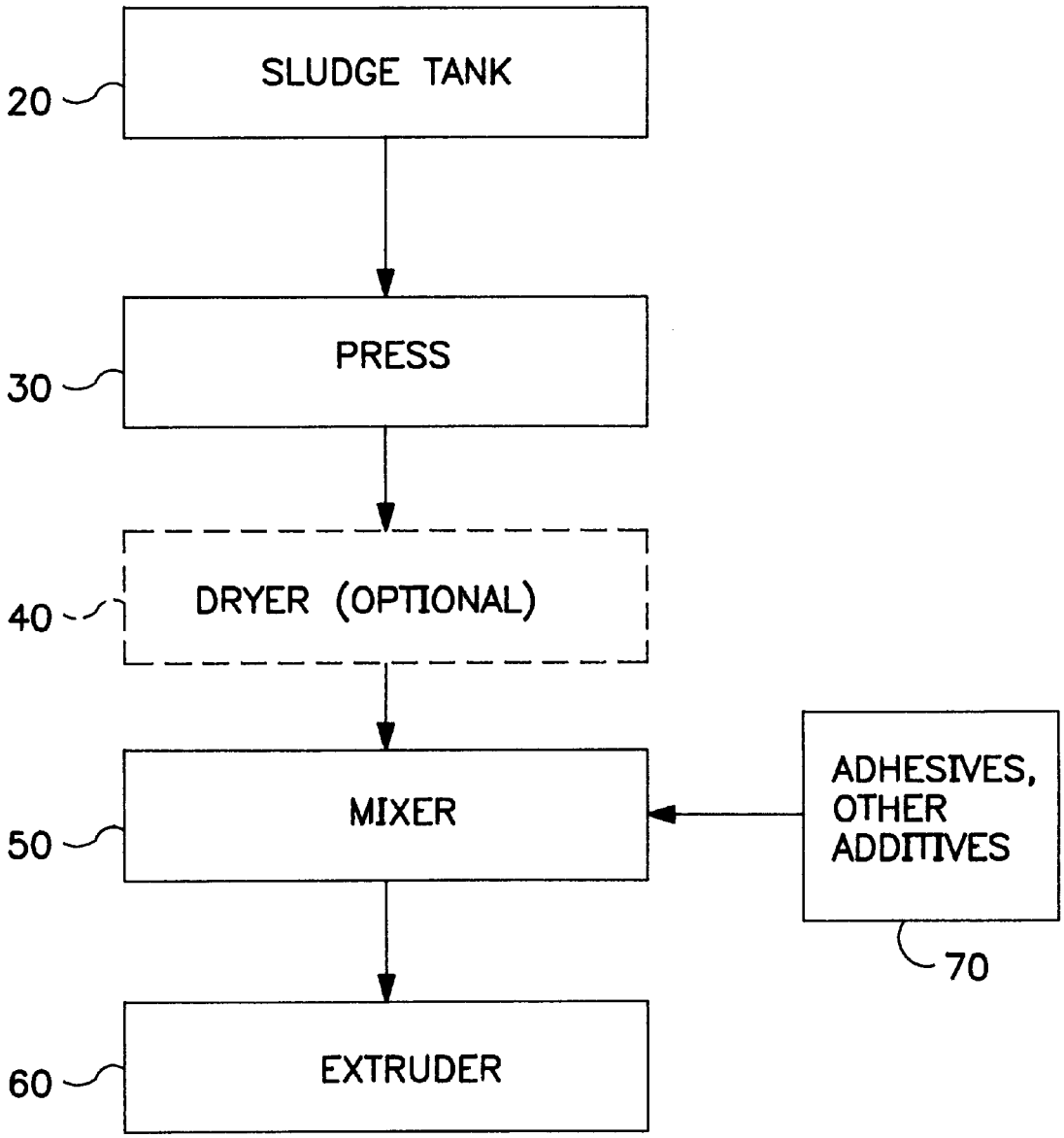
FIG. 1 is a schematic block diagram illustrating one embodiment of the present process for making wound product cores.

Repeat use of reference characters in the present specification and drawings is intended to represent the same or analogous features or elements of the invention.

DETAILED DESCRIPTION OF PREFERRED EMBODIMENT

It is to be understood by one of ordinary skill in the art that the present discussion is a description of exemplary embodiments only, and is not intended as limiting the broader aspects of the present invention, which broader aspects are embodied in the exemplary construction.

Generally speaking, the present invention is directed to a core around which a product, usually a paper product such as tissue, paper towels, wrapping paper, or the like, is wrapped, or rolled. In addition, the core could be the parent roll for use on the winding machines. Such cores are much longer and thicker than the cores upon which the final product, such as tissue, paper towels, or wrapping paper, is wound.

The core of the present invention is made from sludge produced during the process of making paper from virgin wood pulp, the making of virgin pulp from cellulosic materials, the making of paper from recycled fiber, or the making of recycled fiber from waste paper (all referred to herein as papermaking processes). Generally, the sludge is mixed with a binder material and is then compressed by various methods into the inventive cores.

More specifically, the present invention involves obtaining sludge produced during a papermaking process. The sludge is typically subjected to a pressing process which increases the solids content of the sludge to somewhere in the range of about 30 percent to about 50 percent by weight solids. Such presses are common to paper mills and are typically used to dry the produced sludges to acceptable solids contents. With typical belt presses, a solids content of about 30 percent to about 40 percent will be obtained. With typical screw presses, a solids content of about 40 percent to about 50 percent will be obtained. It is to be understood, however, that the stated solids content of sludge is not meant to be limiting, but is merely an example of typical contents found in waste sludge from paper plants.

The pressed sludge may then be treated with an optional drying process to result in a dried sludge with about 90 percent to about 100 percent by weight solids. Next, the prepared sludge is mixed with binder materials such as adhesives like starches or resins. During this step, other additives may be optionally added, such as a dry strength or a wet strength agent. Reinforcing materials, such as wood pulp or common unbleached brown paper stock, may also be added to the mixture. The mixture is then passed to a compression mechanism. Typically, in the present process for making cores, the compression mechanism is either an extruder which can extrude the mixture into roll tubes or a mold which can allow the tubes to be molded.

The cores made from the present process may then be used as winder cores upon which products such as paper towels and tissues may be rolled or wound.

Figure 2:
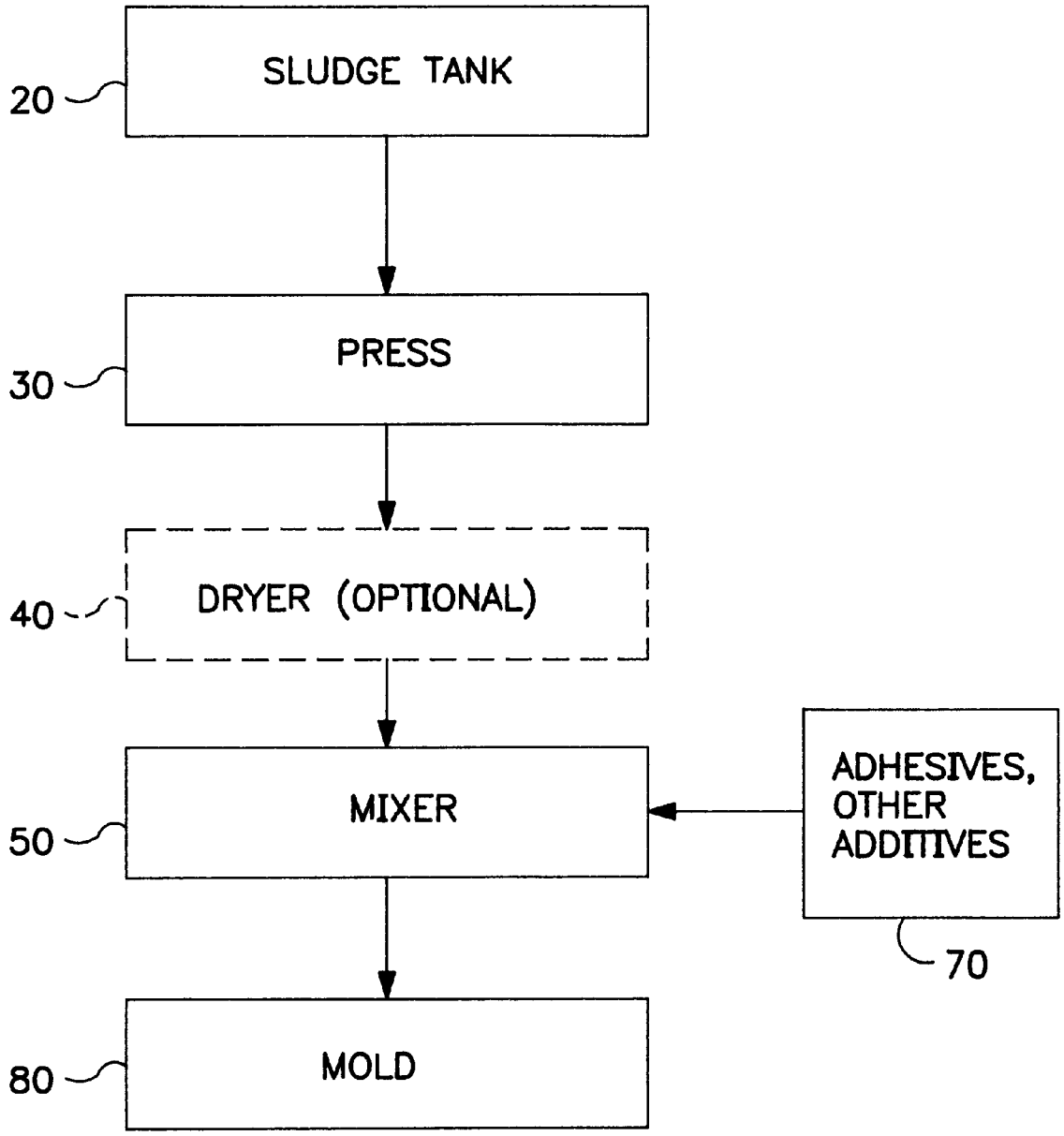
FIG. 2 is a schematic block diagram illustrating another embodiment of the present process for making wound product cores.

As shown in FIGS. 1 and 2, the first step in the process is obtaining the necessary virgin pulp sludge or recycled fiber sludge. Typically, such sludges are housed in a sludge tank 20 at the mill or, in some plants, may come directly from a press 30 after being subjected to the herein described dewatering process. Press 30 may comprise any type of press, all of which would be recognized as applicable by one having ordinary skill in the art. After pressing to obtain a product of between about 30 percent and about 50 percent by weight solids content, the sludge may then be further dried by using the optional dryer 40 shown in the Figures. The mixture is then provided to a mixer 50 where a relatively homogenous mixture is obtained.

Suitable binder materials 70 such as adhesives, including resins, are added to mixer 50. At this point, other materials, such as pulp, may also be added to increase the strength characteristics of the ultimate product. The mixture is then provided to a suitable compression means, typically either an extruder 60 (FIG. 1) or a mold 80 (FIG. 2), for forming the cores.

Among the types of dryers which may be used in the optional drying step include conveyor or belt dryers, flash dryers, fluidized bed dryers, paddle dryers, rotary dryers, spiral screw dryers, tumble dryers, and vibrating dryers. If the drying step is not used, the moisture within the sludge will be removed from the sludge during a heated compression step.

Suitable binder materials that may be mixed with the sludge during the mixing step include any materials that will bind the sludge sufficiently to allow it to be molded or extruded under pressure into a relatively rigid article of manufacture. Typically, the binder agents will cure at temperatures above the boiling point of water and less than about 240° F. Thus, the preferred binders will cure at a temperature of between about 212° F. and about 240° F. For purposes of this specification, the temperatures used herein are given as pressure equivalent temperatures which means that the stated temperatures are those achieved at ambient pressure. If greater pressure is applied, a lower temperature will be equivalent. Likewise, if less pressure is applied, a higher temperature will be equivalent.

Suitable binders include both dry strength agents and wet strength agents. Some binders may require the presence of water to achieve mixability with certain types of sludge. However, if water is added, it should be kept to a minimum, since the water will ultimately affect the mechanical strength of any article ultimately formed during the inventive process.

If the finished cores are to be used for items which are normally not in contact with water, i.e., regular tissue or jumbo tissue cores, a dry strength agent can be used. Suitable dry strength agents include natural starch, ionic starch, polyvinyl alcohol, polyacrylamide, lignosulphate, and carboxymethyl cellulose. Other agents providing characteristics similar to those listed may also be used.

If the finished cores are to be used as reel or (un)winder cores where exposure to moisture is a possibility, both dry and wet strength agents may be used. Suitable wet strength agents include polyamide-epichlorohydrin resins, polyacrylamide resins, insolubilized polyvinyl alcohol, polyethyleneimine resins, and urea and melamine formaldehyde resins. One commercially available wet strength binder for use in the present invention is sold under the name Kymene® sold by Hercules, Inc. Other agents providing characteristics similar to those listed may also be used.

High-intensity mixers are the most suitable ones for use in the present process. High-intensity mixing ensures dispersion of the binders into the dried sludge. Mixer such as ribbon mixers, spiral mixers, kneaders, high-shear mixers, rotary blade mixers and screw mixers may be utilized. Generally, the sludge/binder mixture should be mixed until substantially homogenous. The less homogenous the mixture, the less strength the ultimate product will have.

Compression of the mixed sludge/adhesive to achieve curing of the binder material and ensure sufficient evaporation of the liquid components may be carried out by various processes. The most common processes for use in the present invention are extrusion and molding.

Extrusion can be carried out by continuous extruders such as heated single-screw or twin-screw extruders, typical of the type of extruders used to make PVC piping. If heated twin-screw extruders are used, then the mixing of the binders and the sludge may be carried out in the extruder. During compression, water vapor is evaporated to obtain the desired solids contents, which may vary depending on the mechanical strength desired. Heating can also be accomplished in zones to provide better control of moisture release. The heat and pressure assists in releasing the small amount of moisture remaining as the core exits the extrusion die. The heat applied will generally be somewhere within the range of from about 212° F. and about 240° F. for wet processes.

In one embodiment of the present invention where a relatively wet sludge (non-dried) is utilized, a volume reduction extruder device may be employed. In this type of extruder, the volume within the extruder is constantly reduced between the point the mixture enters the device until the point the mixture enters the die. In this manner, formation pressure on the mixture is gradually increased as volume is gradually decreased. This allows for excess moisture to be evaporated as the mixture moves through the extrusion. Obviously, the length of the die, the relative sizes of the inner and outer compression cylinders, the heat applied, and the speed of extrusion will affect the final product produced by this, as with any, extrusion device.

If an optional drying stage is used, the dryness of the mixture entering into the extruder will depend on the flow characteristics of the mixture. In a normal extruder, the process temperature may be lower. Excess moisture will be further removed after the extruded product exits the die. This would also broaden the range of suitable binding agents for the present invention.

Compression may also be carried out in a mold. In this method, the sludge/binder mixture is poured into a mold that is in the form of the core. Typically, the mold will consist of two different diameter coaxial hollow cylinders. The smaller diameter cylinder is inside the larger one. In one such mold, the structure of the outer cylinder is solid and rigid while the inner cylinder is made of heat or pressure-expandable materials, such as thermoplastic polymers or rubber. In another such mold, the structure of the inner cylinder is rigid and the outer cylinder is made of radially contractible materials. After the mixture is provided into the mold, the inner expandable cylinder is expanded radially by high pressure hydraulic fluid or heat in one arrangement, or the outer contractible cylinder is contracted radially. The mixture is compressed toward the inner wall of the outside cylinder and the outer wall of the inside cylinder in either arrangement. Simultaneously with the compression or contraction, an external press compresses the mixture tangentially. After a certain compression ratio is achieved, the compressing is held constant for a certain time to ensure that the mixture is molded into the final core form. After the release of the compression, the molded core is removed.

The desired strength of the cores will determine the variations in the amount of binder materials, the extrusion or molding pressure, the curing times, and the curing methods (vacuum or heat).

Figure 3:
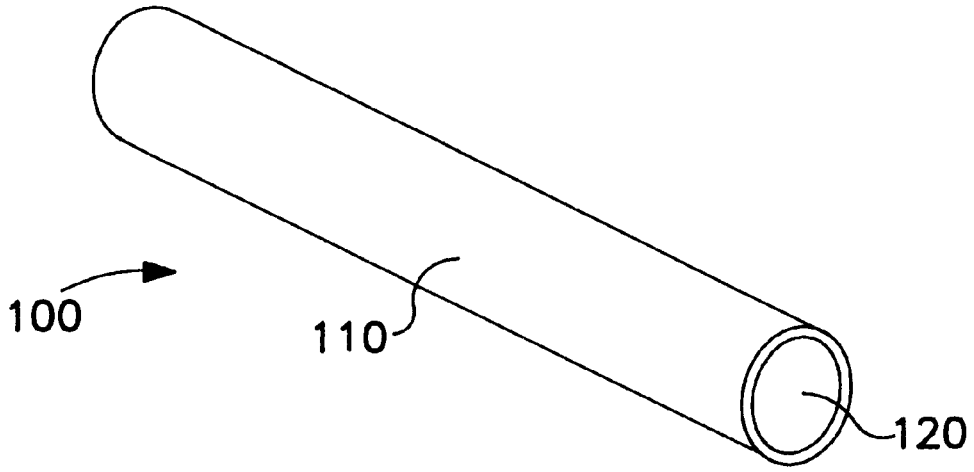
FIG. 3 is a plan view of a core of the present invention.
Figure 4:
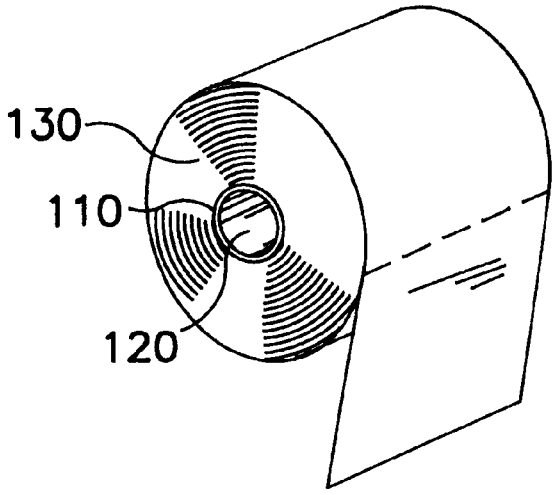
FIG. 4 is a plan view of a core of the present invention having a paper product wound there around in accordance with the present invention.

The produced core, itself, is shown in FIG. 3. As shown, core 100 is a hollow cylindrical tube having an outer surface 110 and inner surface 120. This core is the product made according to the presently described processes. The length of the core tube will depend on the width of the product to be wound onto the core. As indicated above, longer rolls may be cut into smaller width sections for commercial use. A typical core with a paper product wound thereon is shown in FIG. 4. Tissue 130 is wrapped concentrically around the outer surface 110 of core 100.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention, which is set forth in the following claims. In addition, it should be understood that aspects of the various embodiments may be interchanged both in whole or in part.

What is claimed is:

1. A process for producing a core in the shape of a cylindrical tube, said process comprising the following steps:

a) providing a sludge from a papermaking process;

b) forming a mixture by mixing said sludge with a binder material;

c) providing said mixture to a core-forming device that allows the volume of material entering the device to be reduced as the core is formed; and d) compressing said mixture into a core by applying a gradually increasing pressure to said mixture so as to gradually decrease the volume of said mixture and to allow excess moisture from said mixture to be evaporated.

2. The process of claim 1, wherein said sludge comprises fiber sludge obtained from the making of paper from recycled waste paper.

3. The process of claim 1, wherein said sludge comprises fiber sludge obtained from the making of paper from virgin pulp.

4. The process of claim 1, wherein said sludge comprises fiber sludge obtained from the making of virgin pulp from cellulosic materials.

5. The process of claim 1, wherein said sludge comprises fibers sludge obtained from the making of recycled fiber from waste paper.

6. The process of claim 1, wherein said compressing step is performed in a mold.

7. The process of claim 1, wherein said compressing step is performed in a volume reduction extruder.

8. The process of claim 1, further comprising the step of drying said sludge to obtain a solids content of from about 90 percent to about 100 percent prior to mixing said sludge with said binder material.

9. The process of claim 1, wherein said binder material is a wet strength agent.

10. The process of claim 8, wherein said binder material is a dry strength agent.

11. The process of claim 9, wherein said compressing process is performed at a pressure equivalent temperature of from about 212° F. to about 240° F.

12. The process of claim 1, wherein cellulosic pulp is added to said mixture prior to compressing.

13. The process of claim 1, wherein unbleached paper stock is added to said mixture prior to compressing.

14. The process of claim 6, wherein said mold has an outer cylinder and an inner cylinder and wherein at least one of said cylinders is radially expandable or contractable; said decreasing in volume of said mixture being caused by the contracting or expanding of at least one of said cylinders.

15. The process of claim 14, wherein said contracting or expanding of at least one of said cylinders is created by the supplying of hydraulic fluid to the cylinder.

16. The process of claim 14, wherein said contracting or expanding of at least one of said cylinders is created by the heating of said cylinder.

17. The process of claim 6, wherein said mold has an outer cylinder and an inner cylinder and wherein at least one of said cylinders is radially expandable or contractable; said decreasing in volume of said mixture being caused by the contracting or expanding of at least one of said cylinders.

* * * * *